US006065969A

United States Patent [19]

Rifkin et al.

[11] Patent Number: 6,065,969

[45] Date of Patent: May 23, 2000

[54] COMPUTER GAME FOR DESIGNING AND PRINTING NAIL COVERINGS

[75] Inventors: Andrew Rifkin, Palos Verdes; Jesyca C. Durchan, Los Angeles; Chaun Ralls, Redondo Beach, all of Calif.

[73] Assignee: Mattel, Inc., El Segundo, Calif.

[21] Appl. No.: 09/132,133

[22] Filed: Aug. 10, 1998

[51] Int. Cl.[7] ..... G09B 19/00

[52] U.S. Cl. ..... 434/100; 434/99; 700/161

[58] Field of Search ..... 434/100, 99, 98, 434/377, 345; 707/502, 528; 345/977; 463/31

[56] References Cited

U.S. PATENT DOCUMENTS

| | | | |
|---|---|---|---|
| 1,974,466 | 9/1934 | Marshburn | 434/100 X |
| 4,160,271 | 7/1979 | Grayson et al. | 434/100 X |
| 4,824,702 | 4/1989 | Straub . | |
| 5,209,250 | 5/1993 | Taeckens . | |
| 5,309,365 | 5/1994 | Sullivan et al. . | |
| 5,313,267 | 5/1994 | MacFarlane et al. | 434/100 X |
| 5,525,389 | 6/1996 | Hoffmann et al. . | |
| 5,600,563 | 2/1997 | Cannon et al. . | |
| 5,687,087 | 11/1997 | Taggart . | |
| 5,695,346 | 12/1997 | Sekiguchi et al. . | |
| 5,870,771 | 2/1999 | Oberg | 707/502 X |

OTHER PUBLICATIONS

Fashion Magic Fingernail Fun Made by TYCO Catalog (1997) Item 4580.

Barbie Cool Hooks Fashion Designer Mad by Mattel, Inc 1998 Catalog.

*Primary Examiner*—Jessica J. Harrison
*Assistant Examiner*—Chanda Harris
*Attorney, Agent, or Firm*—Roy A. Ekstrand

[57] ABSTRACT

A computer game for designing and printing nail coverings includes a set of stored software instructions receivable within the processor unit of the computer to control operation of a color printer and a series of displayed images upon the monitor display screen. The user is able to call up an image of a hand which may be personalized to a skin tone matching the user's skin tone or may be colored dramatically different. The user is able to select from various icons displayed on the monitor display screen which may then be applied to each nail of the hand image. In addition, a series of photos provided by a digital camera input to the processor unit may be selected and sized to fit within a reference photo frame for use in printing the photo image upon selected nails. Once the color printer has processed the blank laminated sheet, a plurality of nail covers which are formed of the peel and stick self-adhesive structure of the blank sheet are printed upon each nail cover. Each nail cover may be independently removed from the sheet and placed upon a fingernail being attached by the self-adhesive layer thereof.

2 Claims, 3 Drawing Sheets

COMPUTER GAME FOR DESIGNING AND PRINTING NAIL COVERINGS

FIELD OF THE INVENTION

This invention relates generally to computer games and entertainment and particularly to applications thereof associated with fashion and dress items.

BACKGROUND OF THE INVENTION

Computer systems in general have progressed remarkably in recent years. The growth of so-called personal computers is particularly remarkable. Present day personal computers and software exhibit enormous operating power and capability. Correspondingly, accessories for computer driven items such as printers and the like have also increased in power and capability. As a result, a personal computer user is able to produce high quality color graphic output documents using a variety of commercially available software which, several years ago, would have been beyond the practical limits of such systems.

The software which is capable of running on present day personal computers has also progressed dramatically in size, complexity, and power. Somewhat more recently developed compact disks have been provided which accommodate very large complex programs and which are producible at consumer prices. The availability of high capacity consumer priced compact disks has made possible consumer games and entertainment products at prices which the consumer can afford. In most instances, compact disks are provided as read only memory or ROM often referred to "CD ROM". As a result, a steady stream of newly developing computer program products have been provided in fields such as challenging games, business, and other amusement and entertainment.

Despite the extensive development of personal computers and software usable thereon, relatively little development has been provided in areas of interest to young girls such as dress, hair style, or fashion activities. Practitioners have, however, attempted to fill this void in recent years. One of the more popular computer products directed toward young girls having an interest in fashion type play is marketed by Mattel, Inc. in El Segundo, Calif. under the trademark Barbie Fashion Designer in which a program running on a personal computer operates in an interactive manner with a child user to design a wardrobe using a fashion doll image. Having once clothed the fashion doll in the desired apparel items, the user is then able to print out a color keyed pattern of the fashion doll apparel using a color printer operating upon a specially laminated paper which is both cloth and a stiffening backing. The user then cuts out the printed pattern and assembles the doll's apparel using adhesive or two-sided tape or the like.

U.S. Pat. No. 5,600,563 issued to Cannon et al sets forth a SYSTEM FOR PRINTING SOCIAL EXPRESSION CARDS including a data base preparation system and a plurality of remote card printing stations. The data base preparation system uses a scanner to input images from a plurality of cards or software to create a plurality of images for use in card designs, U.S. Pat. No. 5,687,087 issued to Taggart sets forth a CARD PRINTING AND DISPENSING SYSTEM having a video monitor, a consumer interface, a printer, and a computer control. A customer interested in purchasing a card makes a selection using the customer interface from a variety of options displayed on the video monitor or a desired card unique to the occasion. The system is particularly well suited to printing and dispensing unique baseball cards.

U.S. Pat. No. 5,309,365 issued to Sullivan et al sets forth a SYSTEM FOR CUTTING ARTIFICIAL NAIL TIPS AND FOR DECORATING THE SAME OR EXISTING NAILS USING AUTOMATED CUTTING PROCESSES having a sensing device for sensing the dimensions of an existing fingernail structure which supplies information to a controller in machine usable form. The data is used by the controller to drive a variety of peripheral devices to cut a desired nail pattern and assure proper fit.

U.S. Pat. No. 5,209,250 issued to Taeckens sets forth a METHOD FOR ATTACHING AN ARTIFICIAL EXTENSION OF A FINGERNAIL using a fabric fingernail wrap material in which the material is a porous fabric supplied in sheets having releasable adhesive material on one side. The releasable material side adheres to a backing material and shapes of individual fabric elements are cut through the fabric and into the backing material to individually shape fingernail fabric materials.

U.S. Pat. No. 4,824,702 issued to Straub sets forth a TRANSFER ADHESIVE SHEET MATERIAL having one or more adhesive areas positioned between a first liner and one or more corresponding top tab liners. The tab liners have areas which extend beyond the respective adhesive area over a perimeter thereof. The method includes the steps of applying one or more areas of transfer adhesive to the first liner, applying the second liner and die cutting one liner to form the top tab liners having areas extending beyond corresponding adhesive areas. The example is given of fingernail coverings which are adhesively backed.

U.S. Pat. No. 5,525,389 issued to Hoffmann et al sets forth a SELF-ADHESIVE LAMINATE FOR NAILS having a plasticizer containing laminate consisting of a film forming polymeric layer having pigment, a pressure sensitive adhesive layer, and a removable preferably siliconized protective film covering the pressure sensitive adhesive layer.

U.S. Pat. No. 5,695,346 issued to Sekiguchi et al sets forth a PROCESS AND DISPLAY WITH MOVABLE IMAGES having a display device such as a billboard is provided with an image scanned from a paper image of the eventually displayed image.

A product known as Fashion Magic Fingernail Fun Salon set manufactured by Tyco Industries provides a base housing supporting a plurality of enclosure having an aperture for inserting a fingernail. A plurality of fingernail coverings are removable from their respective attachments and securable to cover the player's nails. The nail coverings include various colors as well as color change material and adhesive for securing the nail coverings to the nail. In addition, an air bellows mechanism operative within the enclosures circulates a quantity of glitter flakes which deposit in part upon a surface of the nail covering and are bound there to coat the nail covering with a glitter material.

While the foregoing described prior art devices have improved the art, and have in some instances enjoyed commercial success, there remains nonetheless a continuing need in the art for evermore improved, interesting, and amusing computer fashion type games and entertainment.

SUMMARY OF THE INVENTION

Accordingly, it is a general object of the present invention to provide an improved computer game for fashion and entertainment. It is a more particular object of the present invention to provide an improved computer game for fashion and entertainment activities which is particularly appealing to young girls.

In accordance with the present invention, there is provided a game to be played on a computer system having a display monitor, a mouse and a color printer, the game comprising the steps of: providing a laminated sheet having a base layer and a self-adhesive layer defining a plurality of nail cover cutouts, displaying an image having a hand image having nails on the display monitor together with selection icons for colors and designs, selecting colors and/or designs from the selection icons, transferring each selected color and design to one or more of the nails on the hand image to provide one or more nail images, printing the selected and transferred nail images upon the laminated sheet to provide a sheet having a plurality of colored and/or decorated nail coverings which are peeled from the laminated sheet, and placing the nail coverings on the user's nails.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figure 1:
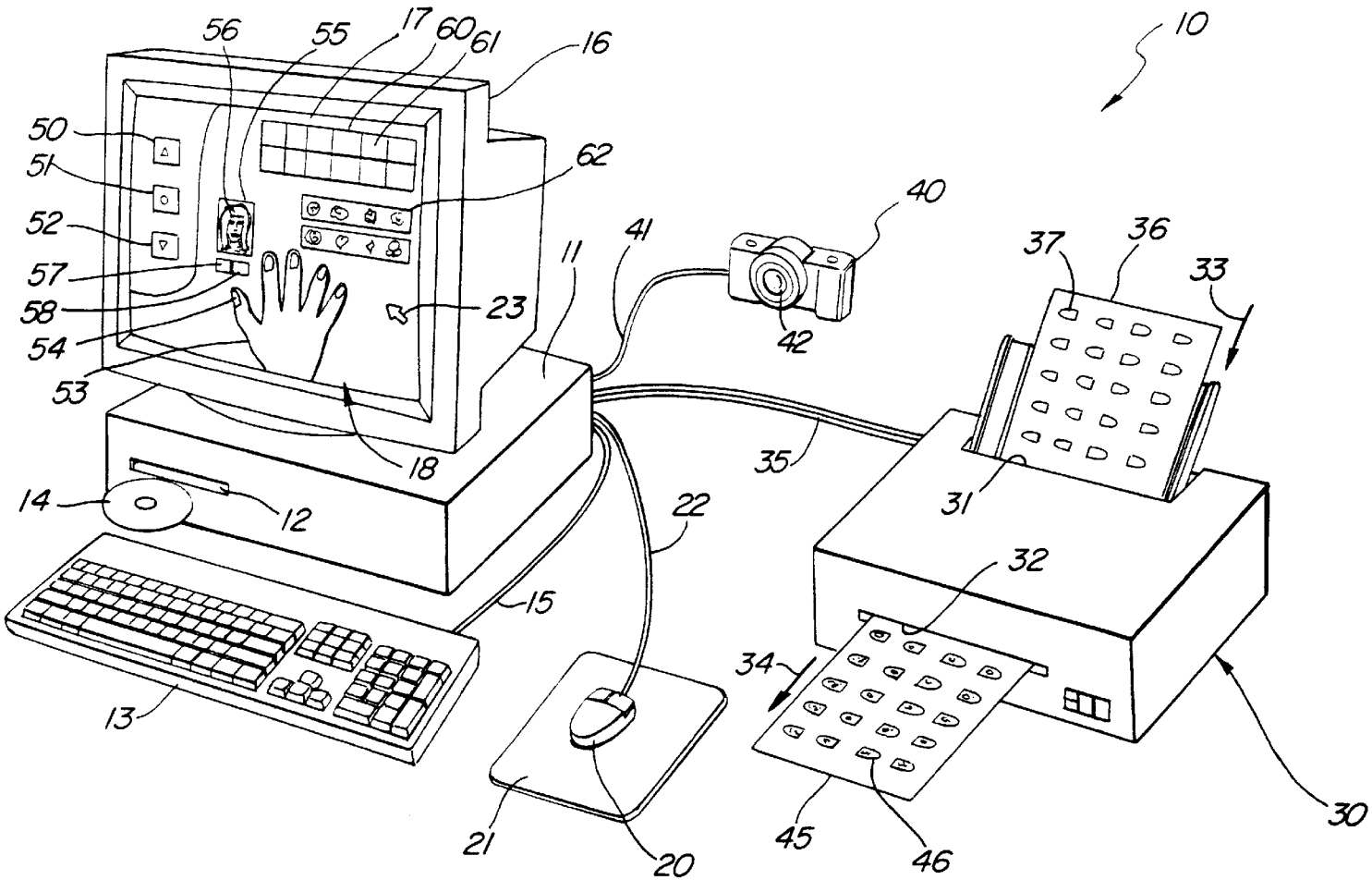
FIG. 1 sets forth a perspective view of a computer system operating in accordance with the present invention computer game.

FIG. 1 sets forth a perspective view of a computer system operating in accordance with the present invention computer game and utilizing the materials of the present invention game which is generally referenced by numeral 10. In accordance with conventional fabrication, computer system 10 includes a processor unit 11 and a keyboard 13 coupled by a cable 15. Processor unit 11 includes a CD ROM drive slot 12 which receives a CD ROM memory 14 in accordance with conventional fabrication techniques. Computer system 10 further includes a monitor 16 coupled to processor unit 11 and having a display screen 17. Typically, display screen 17 comprises a cathode ray tube or equivalent color display device. Computer system 10 further includes a mouse 20 coupled to processor unit 11 by a cable 22 and resting upon a mouse pad 21. A color printer 30 having an input 31 and an output 32 is operatively coupled to processor unit 11 by a cable 35. Finally, a digital camera 40 having a lens 42 is coupled to processor unit 11 by a cable 41.

Computer system 10 as thus far described is fabricated entirely in accordance with conventional fabrication techniques. In accordance with the present invention, CD ROM 14 is encoded with a game software program which operates processor 11 in controlling printer 30 and monitor 16 to provide the game play set forth below in greater detail. In addition, digital camera 40 which is fabricated in accordance with conventional fabrication techniques, includes well known circuitry for communicating a digitized picture having been imaged through lens 42 to processor unit 11 allowing processor unit 11 to either print the digitized image and/or display it on display screen 17.

In further accordance with the present invention, a laminated paper 36 fabricated as set forth below in FIG. 2 and having a plurality of nail covers such as nail cover 37 arranged thereon is placed within input 31 of color printer 30. In further accordance with the present invention game, an illustrative image 18 is shown displayed upon display screen 17. For further illustration of the operation of the present invention game, a laminated sheet 45 is shown having passed through printer 30 and being dispensed outwardly from output 32 in the direction indicated by arrow 34.

In operation, CD ROM 14 is loaded into processor unit 11 via input slot 12 allowing processor unit 11 to assimilate the data from CD ROM 14 and initiate game play. Thereafter the user manipulates keyboard 13 and mouse 20 to provide input and selections to the game play. In particular, mouse 20 is extremely useful controlling a pointer 23 which is operable upon image 18 in the well known "point and click" selection process.

Once the game program has been loaded into processor unit 11, the processor goes through initialization steps during which the user inputs choices using mouse 20 and point and click operation. Of particular importance with respect to the present invention is the composite image presented as image 18. For purposes of illustration, a number of features are shown simultaneously displayed upon screen 17 within image 18. However, it will be understood that various combinations and subcombinations of such illustrative image elements may be presented without departing from the spirit and scope of the present invention. For purposes of illustration, image 18 includes a plurality of style selection icons 50, 51, and 52 which allow the user to choose the particular type of nail decoration to be undertaken. In addition and in further accordance with an important aspect of the present invention, the user is able to select the display of a hand image 53 having a plurality of nails such as nail 54. As is set forth below, the user is then able to access a color palette such as color palette 60 to customize the display of hand image 53 to the user's skin tone. The customized hand image may then be operated upon using a selection process. For example, to place a color upon a given nail such as nail 54, the user maneuvers mouse 20 upon pad 21 to the selected color cell such as cell 61 in color palette 60. Thereafter having clicked on cell 61, the user moves the pointer 23 to nail 54 and again clicks causing nail 54 to be colored in accordance with the color of cell 61. This process may be carried out on the remaining nails. In addition to base color selection, the user is able to select from various design icons on image 18 such as design icon 62. As the user points and clicks to design icon 62 and thereafter places the pointer upon a selected nail such as nail 54, the clicking on nail 54 imprints nail 54 with the design corresponding to icon 62.

In accordance with a further advantageous operation of the present invention game system, image 18 further includes a photo frame 55 which may be used to select a photo such as photo 56 to be placed therein. Digital camera 40 operating in accordance with conventional fabrication techniques, couples digitized signals via cable 14 to processor 11 for storage in memory. A plurality of digital images may be simultaneously stored in memory and selected by a point and click process using mouse 20. In addition a standard image group such as well known characters or persons may be stored within memory in processor unit 11 to be selectable by the user. Once a photo image has been selected, the user points to photo frame 55 and clicks to install a photo such as photo 56. With the installation of a photo within photo 56, the user is provided with one or more manipulation choices such as image larger icon 57 or image smaller icon 58.

Once the various manipulations referred to above have been completed, and the user has selected the desired decoration and coloring of the nails upon hand image 53, the user then inputs a print command via keyboard 13 or mouse 20 causing processor unit 11 to transfer the images for the nail coverings to color printer 30. A laminated paper 36 having a plurality of nail cover cutouts and fabricated as set forth below in FIG. 2 is then inputted to color printer 30. For purposes of illustration, a laminated sheet 45 having a plurality of decorated and colored nail cutouts such as nail cover 46 is shown outputting from printer 30. It will also be noted that having printed the desired nails on sheet 45 and once laminated sheet 36 has been similarly printed, the user may either exit the program or may return to the initial display and using a command input, reverse hand image 53 from the right hand shown to a left hand and again go through the process to print decorative nail coverings for the left hand. In further accordance with the present invention game set forth below in FIG. 2, the fabrication of laminated sheets 36 and 45 provides base layer supporting a self-adhesive layer which in turn defines a plurality of nail covering cutout areas. The printing process within processor unit 11 includes means for locating the various design and colors to be printed on nail cover cutouts on a given sheet so as to correspond with the location of the nail cover cutouts.

Figure 2:
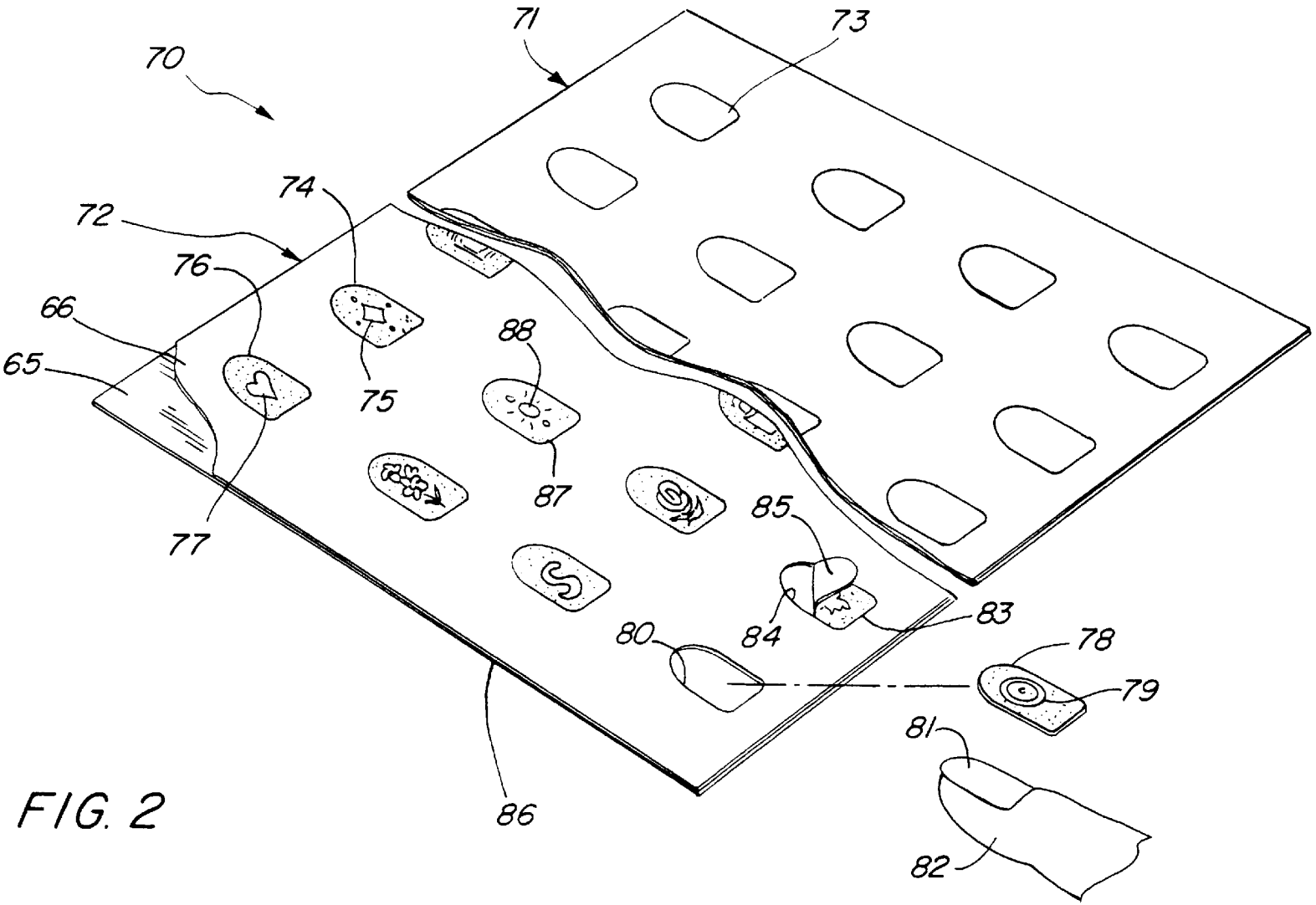
FIG. 2 sets forth a partially sectioned perspective view of the print media of the present invention computer game showing printing and coloration of nail coverings.

FIG. 2 sets forth a perspective partially sectioned view of an exemplary laminated sheet 70. In accordance with the preferred fabrication of the present invention, laminated sheet 70 utilizes a popular self-adhesive arrangement in which a generally adhesive impervious base layer 65 such as wax treated paper or the like receives a cutout layer 66 having a self-adhesive layer 86 on the bottom surface thereof. The self-adhesive quality of layer 66 and the impervious quality of base layer 65 allow easy separation of the cutout layer from the base layer in which self-adhesive layer 86 remains on the undersurface of cutout layer 66. As a result, each cutout for nail covers such as nails 73 and 74 forms a "peel off" self-adhesive member which may readily be applied to the user's nails and which will adhere thereto.

For purposes of explanation, sheet 70 is shown sectioned to illustrate a blank portion 71 and a printed portion 72. It will be understood, however, that in accordance with the operation set forth in FIG. 1, an entire sheet such as blank portion 71 is initially inputted to printer 30 and a printed portion such as portion 72 is typically outputted as a complete sheet. However, for convenience, it is advantageous to illustrate the two stages of use in a composite in FIG. 2.

Thus blank portion 72 illustrates the condition of an input sheet prior to any printing. As will be noted, a plurality of nail covers such as nail cover 73 are cut out in cutout layer 66 to form a plurality of peel off self-adhesive members. Once blank portion 71 has been processed through color printer 30 (seen in FIG. 1) and become printed portion 72, the plurality of nail covers formed thereon have been enhanced with various color shades and, if chosen by the user, various designs. For purposes of illustration, nail covers 74 and 76 are shown in a color variation and having designs 75 and 76 thereon.

With temporary return to FIG. 1, it will be noted that selection of the designs to be added to the various nail covers of a printed laminar sheet are selected using design icons such as design icon 62, various colors using color palette 60, and the selection of a photo 56 within photo frame 55.

Returning to FIG. 2, for further illustration, cutout 87 of printed portion 72 shows a nail cover 87 bearing a photo 88 which was selected by the user in operation of computer system 10 in the manner described above.

Once sheet 70 has finished the color printing process, the user is able to simply peel off the desired nail covers such as nail cover 78 having design 79 thereon for application to a nail such as nail 81 of finger 82. The peeling off of nail cover 78 leaves a cutout hole in layer 66 generally referenced by numeral 80. Similarly, nail cover 83 is shown partially peeled from cutout 88 revealing self-adhesive layer 85 on the underside thereof. This process continues until the user has successfully transferred the desired combination of nail coverings from sheet 70. Thereafter sheet 70 may be stored for subsequent use of the remaining nails thereon or discarded in favor of printing a new set using the above-described process.

Figure 3:
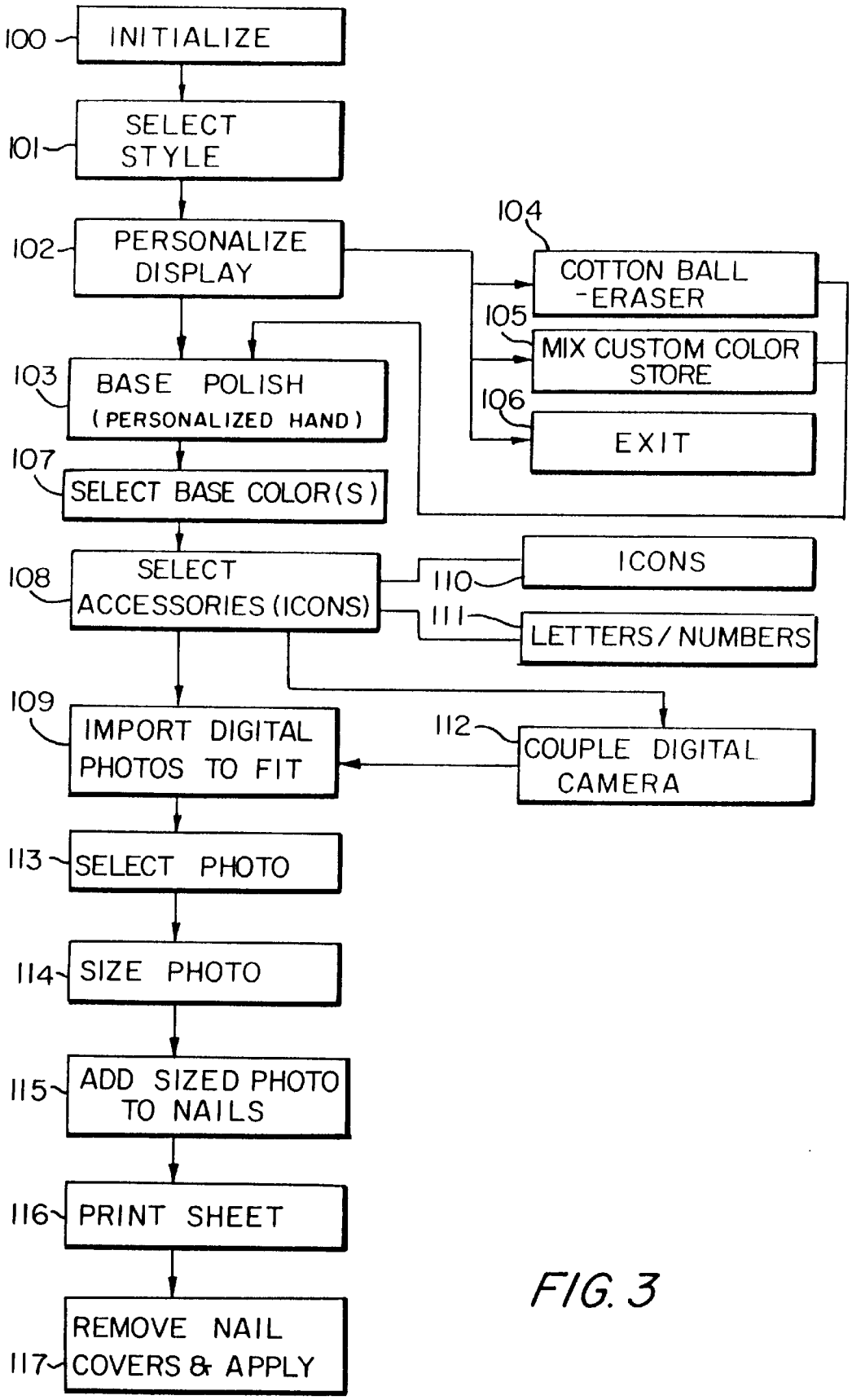
FIG. 3 sets forth a flow diagram of the operation of the present invention computer game.

FIG. 3 sets forth a block diagram of the present invention game play which begins at a step 100 in which the preparation for game play takes place such as loading the above-described CD ROM and allowing the processor unit to initialize and configure printer 30 and display monitor 16 (seen in FIG. 1). Thereafter in response to display screen presentation, the user may select the style of nail decoration to be attempted at step 101. At step 102, the user is then able to personalize the display of a hand image selecting left or right as well as skin tone in a point and click operation. In addition, the user is able to increase the size of the displayed nails using a magic emery board click on or decrease the size of displayed nail images using a fingernail scissors click on. Once the user has the color tone and size of the nails in the image hand closely approximated to their own or alternatively to some other hand style such as high fashion models or the like, the user is able to enter a series of customizations in which the user is able to mix a custom color and store it for later use at step 105 or alternatively exit the system at step 106. During the processes of decorating the exemplary nails, the user may click on to a cotton ball icon which performs a complete erase feature on the decorated nails. At step 103, a base polish color is selected to be placed on the nails of the image hand. The user may select different colors for each nail and may select either colors displayed on palette 60 (seen in FIG. 1) or alternatively may select the previous custom mixed color at step 105 which has been stored awaiting use. In any event, once the user has determined the colors for the nails, at step 107, the user selects and paints the base nail colors on the nails.

Once the image nails on the image hand have been colored with the base color, the system moves to a step 108 in which a selection of accessory decorations is carried forward. At step 110, a plurality of icons each corresponding to a particular design is selectable by the user. Alternatively, a plurality of letters or numbers may be selected at step 111 for secret message encryption. Finally, at step 112, the photo input from digital camera 40 (seen in FIG. 1) may be utilized processing the above-described operation at step 109 in which the photo is placed within photo frame 55 on image 18 (seen in FIG. 1) and is altered in size to present a suitable photo for use within the photo frame. It will be apparent to those skilled in the art that the size of photo frame 55 is selected in accordance with the resulting size of design upon nail covers such as nail cover 37 (shown in FIG. 1). The process of importing, selecting, and sizing the photo takes place variously within steps 109, 113, and 114. At step 115, a sized photo is added to the nails of the hand image (hand image 53 in FIG. 1). Following step 115, the user is able to go back and change various selections should that be desired. However, assuming no further changes are to be made, the system moves to a print stage 116 in which the user prints the selected colorations and images upon the nail coverings supported in a laminated sheet such as sheet 70.

At step 117, the now printed and imaged nail covers are removed from the laminated sheet to provide self-adhesive nail covers which may be applied in a simple press on manner to the child user's nail.

Thus what has been shown is a computer game for designing and printing nail coverings which utilizes a color printer operative upon a plurality of laminated self-adhesive sheets bearing a plurality of nail coverings in cutout arrangement. A controlling program is inputted to the processor of the computer and operates to present a series of images including a hand image which may be colored and decorated in accordance with the user's selection. In addition, a plurality of photos may be inputted to the processor unit for addition to the pre-stored nail decorations representing the user's selection. The results is an interesting and amusing game play in which a virtually endless variety of colored and decorated nail coverings may be provided at a very low cost in a process which avoids the need to utilize potentially messy components such as bottles of adhesive, paints, or nail polishes.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game to be played on a computer system having a display monitor, a mouse and a color printer, said game comprising the steps of:

providing a laminated sheet having a base layer and a self-adhesive layer defining a plurality of nail cover cutouts;

displaying an image having a hand image having nails on said display monitor together with selection icons for colors and designs;

selecting a hand color from said selection icons to color said hand image in accordance with said selected hand color;

selecting colors and/or designs from said selection icons;

presenting a picture frame image;

retrieving a stored photo image;

placing said retrieved stored photo image within said picture frame;

adjusting the size of said retrieved stored photo image;

adding said photo image to said designs;

transferring each selected color and design including said added photo images to one or more of said nails on said hand image to provide one or more nail images;

printing said selected and transferred nail images upon said laminated sheet to provide a sheet having a plurality of colored and/or decorated nail coverings which are peeled from said laminated sheet; and placing said nail coverings on the user's nails.

2. The game set forth in claim 1 wherein said displaying step includes the steps of:

receiving a plurality of digitized photos; and storing said digitized photos for use in said retrieving step.

* * * * *